United States Patent [19]

Van Renssen

[11] 4,190,936

[45] Mar. 4, 1980

[54] APPARATUS AND METHOD FOR DETERMINING DEVIATION OF MASK-TO-FACEPLATE SPACING IN A CATHODE-RAY TUBE

[75] Inventor: Marinus Van Renssen, Leola, Pa.

[73] Assignee: RCA Corporation, New York, N.Y.

[21] Appl. No.: 953,938

[22] Filed: Oct. 23, 1978

[51] Int. Cl.[2] ..... H01J 9/18

[52] U.S. Cl. ..... 29/25.15; 29/25.19

[58] Field of Search ..... 29/25.13, 25.15, 25.16, 29/25.19

[56] References Cited

U.S. PATENT DOCUMENTS 3,482,286 12/1969 Fassett et al. ..... 29/25.13

*Primary Examiner*—Richard B. Lazarus

*Attorney, Agent, or Firm*—E. M. Whitacre; G. H. Bruestle; D. H. Irlbeck

[57] ABSTRACT

Apparatus and method are provided for determining the deviation in mask-to-faceplate spacing from a desired spacing during cathode-ray tube construction. The apparatus utilizes the novel method which comprises the steps of sensing the position of the interior surface of a faceplate without a shadow mask being mounted adjacent the faceplate, mounting a shadow mask adjacent the faceplate and sensing the position of a side of the shadow mask opposite the faceplate. The difference in the two second positions minus the shadow mask thickness is the deviation in the desired mask-to-faceplate spacing.

7 Claims, 5 Drawing Figures

APPARATUS AND METHOD FOR DETERMINING DEVIATION OF MASK-TO-FACEPLATE SPACING IN A CATHODE-RAY TUBE

BACKGROUND OF THE INVENTION

This invention relates to the assembly of cathode-ray tubes, and particularly to an apparatus and method for checking the mask-to-faceplate spacing in a cathode-ray tube during assembly.

Commercial shadow-mask-type picture tubes for color-television receivers include a panel comprising a faceplate having, on its inner surface, a mosaic viewing screen of different color emitting phosphor elements and an electron-gun structure for projecting a plurality of electron beams toward the screen. A curved apertured shadow mask is attached to a frame and mounted in the faceplate panel at a prescribed spacing from the screen. The prescribed spacing is designated q and is defined to be the distance between the screen and the mask measured parallel to the central longitudinal axis of the tube. In the operation of the tube, the electron beam paths are such that each beam impinges upon and excites only one kind of color-emitting phosphor on the screen while being shielded from the other color-emitting phosphor elements by the apertured mask.

In a method for mounting a mask in a color television picture tube, the mask is first attached to a frame to produce a mask-frame assembly. A q-spacer, having a plurality of fixed distance spacing units, is positioned on the inner concave surface of the faceplate. The mask-frame assembly is inserted within the panel over the q-spacer and temporarily mounted on the panel studs by means of leaf springs frictionally engaging hook plates located on the frame. Thereafter, the leaf springs are welded to the hook plates on the frame. In order to check the established q distance, the mask-frame assembly and the spacer insert next are removed and a q-spacing gauge is inserted into the panel. The mask-frame assembly is then reinserted and the q distances are measured. After the q distances are measured, the mask-frame assembly must be removed in order to remove the q-spacing gauge and thereafter reinserted again.

It is desirable to reduce the number of times a mask is inserted and withdrawn from a faceplate panel in order both to reduce damage to the mask that may be caused by handling and to speed the assembly process. The present invention eliminates one of the mask withdrawal and insertion steps by providing novel apparatus and method for checking the mask-to-faceplate q-spacing without the insertion of a gauge between the mask and faceplate.

SUMMARY OF THE INVENTION

The present invention provides apparatus and method for determining the deviation in mask-to-faceplate spacing from a desired spacing during cathode-ray tube construction. The apparatus utilizes the novel method which comprises the steps of sensing the position of the interior surface of a faceplate without a shadow mask being mounted adjacent the faceplate, mounting a shadow mask adjacent the faceplate and sensing the position of a side of the shadow mask opposite the faceplate. The difference in the two sensed positions minus the shadow mask thickness is the deviation in the desired mask-to-faceplate spacing.

DESCRIPTION OF THE PREFERRED EMBODIMENT

Figure 1:
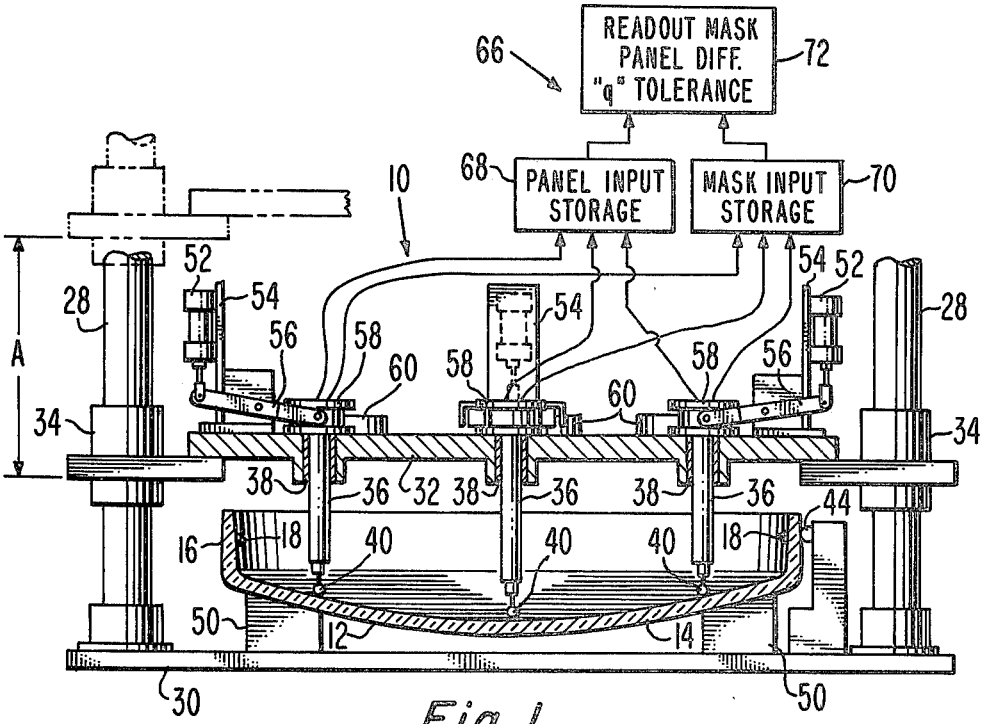
FIGS. 1 and 2 are partially sectional elevational views of an apparatus constructed in accordance with one embodiment of the present invention.
Figure 2:
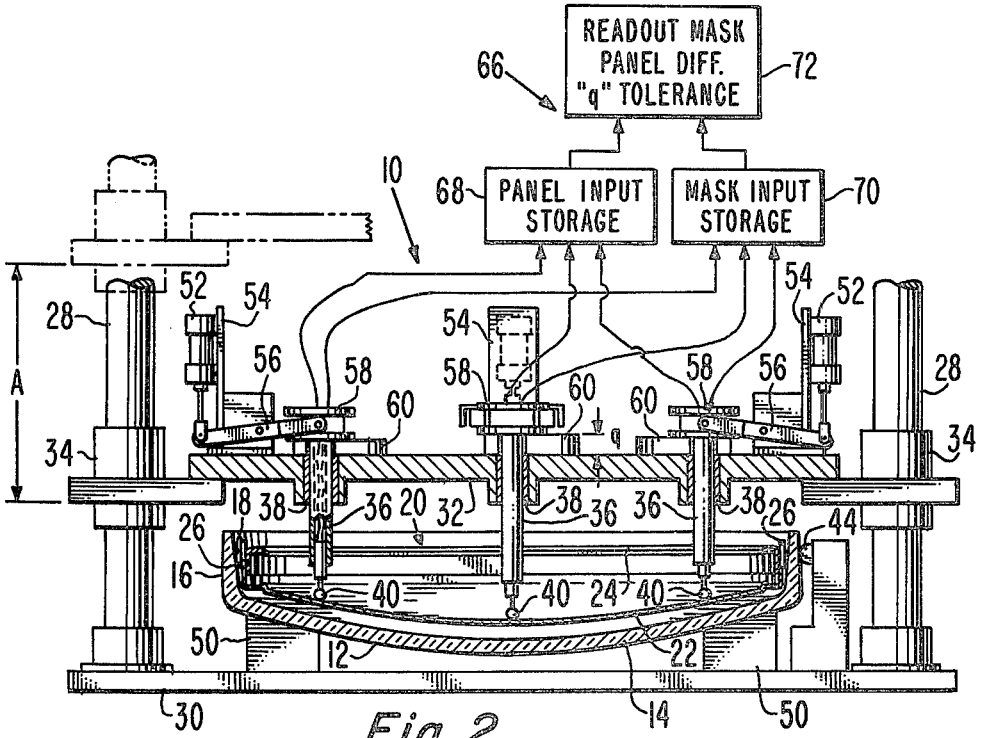

FIGS. 1 and 2 illustrate an apparatus 10 for measuring mask-to-faceplate spacing during construction of a color picture tube. A color picture tube faceplate panel 12 is positioned on the apparatus 10. The panel 12 comprises a front or viewing faceplate 14 on which a phosphor screen will be deposited. Extending from the faceplate 14 is a peripheral skirt 16 in which 3 or 4 support studs 18 are embedded. As shown in FIG. 2, the studs 18 support a shadow mask assembly 20, comprising an apertured mask 22 and a peripheral reinforcing frame 24, on a plurality of springs 26 relative to the faceplate 14.

Figure 3:
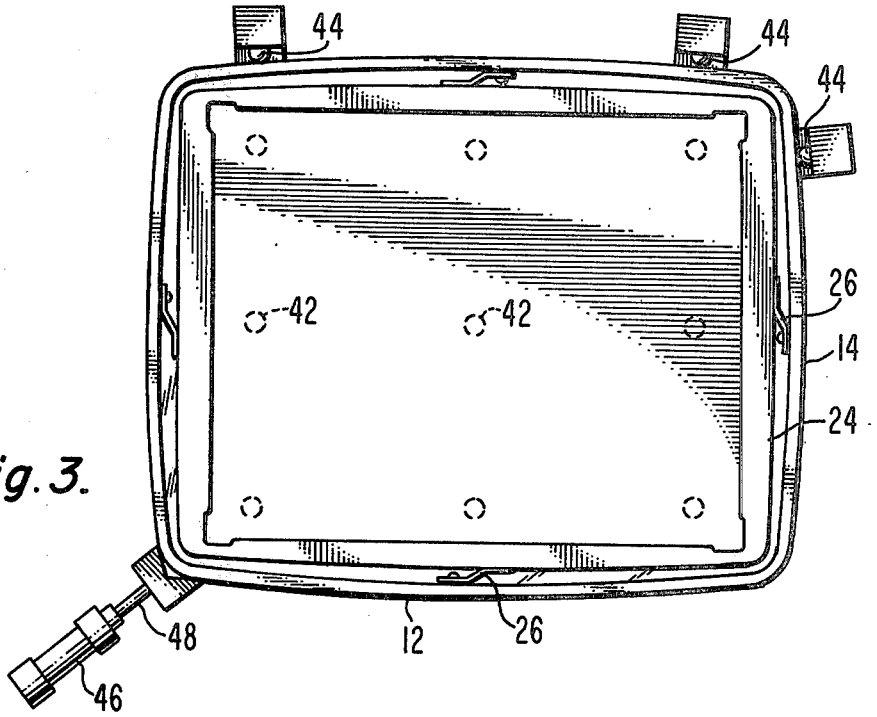
FIG. 3 is a plan view of a cathode-ray tube faceplate panel having an apertured mask mounted therein.

The apparatus 10 includes two vertical support rods 28 extending from a rigid base 30. A platform 32 is slidably attached to the rods 28 by two sliding collars 34. The platform 32 can be raised or lowered by means of a rack and a pinion (not shown). Nine (only three shown) sensor units 36 are slidably supported within bushings 38 by the platform 32. Each sensor unit 36 includes a probe 40 which is pointed downward. The locations of the nine sensor units 36 are shown by the circles 42 indicated in FIG. 3. This drawing also shows the means for accurately locating the faceplate panel 12. Such means comprises three reference units 44, two at one corner and one along an adjacent side, and a pneumatic cylinder 46 having a piston rod 48 engaging the corner of the faceplate panel 12 opposite the two corner reference units 44. The piston rod 48 exerts a force on the panel 12 which holds the panel 12 firmly against the reference units 44. The panel 12 sets on four pads 50 having spherically curved top surfaces. The pads 50 rest directly on the base 30.

Figure 4:
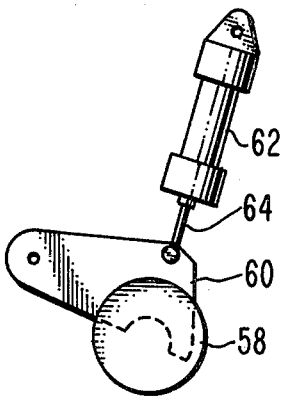
FIG. 4 is a sectional view on section line 4—4 of FIG. 2.

Each sensor unit 36 is positionable relative to the platform 32 by activation of a pneumatic cylinder 52. The cylinders 52 are supported on the platform 32 by means of brackets 54 extending upwardly from the platform 32. The piston rod of each cylinder 52 is pivotally connected to one end of a lever 56. Each lever 56 is pivotally connected at its center to a respective bracket 54 and at the other end to a shouldered stop 58 which is attached to a respective sensor 36. When sensing the interior surface of the faceplate panel 12, the stop 58 rests against the top surface of the platform 32. However, for measuring the shadow mask 22, spacer blocks 60 are interposed between the stops 58 and the top surface of the platform 32. One of these blocks 60 is shown in FIG. 4 wherein the block 60 has been inserted under a stop 58 by action of a cylinder 62 having one end attached to the platform 32 and its piston rod 64 attached to the spacer block 60. Output signals from the sensors 36 are connected into associated electronics 66 which have a capacity for storing the measurements taken and displaying the difference between panel and mask positions. These electronics comprise a faceplate panel input storage unit 68, a mask input storage unit 70 and a display unit 72.

Operation of the apparatus 10 begins when a faceplate panel 12 is placed on the pads 50 and the cylinder 46 is activated to force the panel against the reference units 44. At this point, the platform 32 is in a raised position shown by the dashed lines in FIGS. 1 and 2. Now the platform 32 is lowered a distance A to a precise position as shown in FIG. 1. Thereafter, the cylinders 52 are activated to lower the sensors 36 until the stops 58 contact the top surface of the platform 32. In this position, the sensor probes touch the inner surface of the faceplate 14. Each sensor 36 produces an electrical output which is indicative of faceplate location. These outputs are fed into the panel input storage unit 68 where they are retained. The cylinders 52 now are activated to raise the sensors 36 and the platform 32 is lifted to its raised position. Next, the mask 22 is inserted in the faceplate panel 12 and the platform 32 is lowered. Cylinders 62 now are activated to position the spacer blocks 60 under the stops 58 and the cylinders 52 lower the sensors 36 unit the stops 58 rest against the spacer blocks 60. The thickness of the blocks 60 are equal to the desired mask-to-faceplate spacing plus the thickness of the mask. Therefore, if the mask 22 were exactly positioned relative to the faceplate 14, the output of the sensors would be identical to the output measurement taken for the faceplate. The outputs from the sensors 36 are now fed to the mask input storage unit 70, are compared to the readings previously stored in the panel input storage unit 68 and the differences between the readings for the nine sensor locations are displayed by the display unit 72. This information represents the deviation in q spacing from that desired. Usually, tolerance limits are put on the desired spacing (also called bogie spacings) and when the deviations are within these limits, the mask spacing is acceptable. When the deviations are beyond the limits, the mask-faceplate assembly is rejected.

A preferred sensor is a LVDT type such as model number 6021A DO656 manufactured by ATC or model number PCA-220-100 manufactured by Schaevitz.

Figure 5:
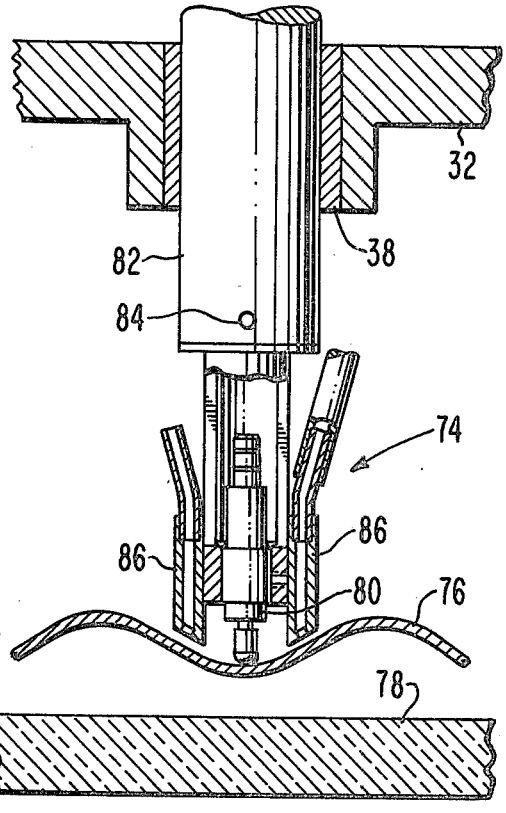
FIG. 5 is a partially sectional elevational view of a sensor that can be substituted into the apparatus of FIGS. 1 and 2 for use with a corrugated apertured mask.

Recently, interest has been shown in tubes having flat faceplates and corrugated masks. A basic problem encountered in measuring corrugated mask spacings is that the sensor probe sometimes does not touch the mask at a point closest to the faceplate. FIG. 5 shows a modified sensor unit 74 being used in measuring mask-to-faceplate dimensions for a corrugated mask 76 and a flat faceplate 78. This unit 74 includes a sensor 80 pivotally mounted to a tubular housing 82 by a pin 84. The housing 82 is positioned in the bushing 38 of a platform 32. Two air nozzles 86 are located on each side of the sensor 80 so that air can be directed downwardly at a slight angle away from the longitudinal axis of the sensor 80. Air emitted from the nozzles 86 strike the higher portions of the mask 76 and move the location of the sensor 80 about the pivot pin 84 until the air jets are equalized. Such equalization moves the probes 80 to the lowest or closest spacing point of the mask 76.

I claim:

1. A method for determining the deviation in shadow mask-to-faceplate spacing from a desired spacing during cathode-ray tube construction comprising the steps of, sensing the position of the interior surface of a faceplate without a shadow mask being mounted adjacent said faceplate, mounting a shadow mask adjacent said faceplate, and sensing the position of a side of said shadow mask opposite said faceplate, determining the difference in the two sensed positions minus the shadow mask thickness which is the deviation in the mask-to-faceplate spacing, and accepting or rejecting the assembly based on whether the deviation is within desired limits.

2. A method for determining the deviation in shadow mask-to-faceplate spacing from a desired spacing during cathode-ray tube construction comprising the steps of, positioning a sensor in a first position relative to a faceplate with a probe of said sensor in contact with the inner surface of said faceplate, the output of the sensor in the first position indicating the location of said faceplate, mounting a shadow mask adjacent said faceplate, and positioning said sensor in a second position relative to said faceplate after said shadow mask is mounted, the second position being spaced from the first position a distance equal to the desired mask-to-faceplate spacing plus the thickness of said mask, the output of the sensor in the second position indicating the location of said mask, determining the difference in the sensor outputs for the first and second positions which is the deviation in mask-to-faceplate spacing, and means accepting or rejecting the assembly based on whether the deviation is within desired limits.

3. A method for determining the deviation in shadow mask-to-faceplate spacing from a desired spacing during cathode-ray tube construction comprising the steps of, sensing the distance of the interior surface of a faceplate from a first reference plane without a shadow mask being mounted adjacent said faceplate, mounting a shadow mask adjacent said faceplate, and sensing the distance of a side of said shadow mask opposite said faceplate from a second reference plane, the second reference plane being displaced from the first reference plane in a direction away from said faceplate a distance equal to the desired mask-to-faceplate spacing plus the thickness of said shadow mask, determining the difference in the two sensed distances which is the deviation in the mask-to-faceplate spacing, and accepting or rejecting the assembly based on whether the deviation is within desired limits.

4. Apparatus for determining the deviation in shadow mask-to-faceplate spacing from a desired spacing during cathode-ray tube construction comprising, means for sensing the distance of the interior surface of a faceplate from a first reference plane without a shadow mask being mounted adjacent said faceplate, and means for sensing the distance of a side of a shadow mask opposite said faceplate from a second reference plane while said shadow mask is mounted adjacent said faceplate, the second reference plane being displaced from the first reference plane in a direction away from said faceplate a distance equal to the desired mask-to-faceplate spacing plus the thickness of said shadow mask, means determining the difference in the two sensed distances which is the deviation in the desired mask-to-faceplate spacing, and means accepting or rejecting the assembly based on whether the deviation is within desired limits.

5. Apparatus for determining the deviation in shadow mask-to-faceplate spacing from a desired spacing during cathode-ray tube construction, comprising, means for holding a cathode-ray tube faceplate, a platform moveable relative to said means for holding, a plurality of sensors moveably mounted on said platform, means for moving said sensors relative to said platform, means for locating said sensors in first positions relative to said platform, and means for locating said sensors in second positions relative to said platform, said first and second positions being separated by the desired mask-to-faceplate spacings plus the thickness of a shadow mask.

6. The apparatus as defined in claim 5 wherein said means for locating said sensors in a first position includes stops on said sensors abutting a surface of said platform.

7. The apparatus as defined in claim 6 wherein said means for locating said sensors in a second position includes blocks having thicknesses equal to the desired mask-to-screen spacings at each sensor location, plus the thickness of a shadow mask.

* * * * *